US005860307A

United States Patent [19]

Nakano et al.

[11] Patent Number: 5,860,307

[45] Date of Patent: Jan. 19, 1999

[54] METHOD AND APPARATUS FOR FORMING A BENT PIPE

[75] Inventors: Tamio Nakano, Kariya; Shin Takeda, Nagoya; Kiyoshi Takeuchi, Toyota, all of Japan

[73] Assignee: Aisin Seiki Kabushiki Kaisha, Kariya, Japan

[21] Appl. No.: 738,687

[22] Filed: Oct. 28, 1996

[30] Foreign Application Priority Data

Oct. 27, 1995 [JP] Japan ..... 7-281035

[51] Int. Cl.[6] ..... B21B 39/02; B21B 17/02; B21D 9/05

[52] U.S. Cl. ..... 72/133; 72/150; 72/370.01

[58] Field of Search ..... 72/149, 133, 150, 72/152, 155, 157, 166, 367.1, 369, 370.01

[56] References Cited

U.S. PATENT DOCUMENTS 1,105,914 8/1914 Miller ..... 72/150

FOREIGN PATENT DOCUMENTS 5-12047 2/1993 Japan .
6-42967 6/1994 Japan .

*Primary Examiner*—Joseph J. Hail, III
*Assistant Examiner*—Rodney Butler
*Attorney, Agent, or Firm*—Oblon, Spivak, McClelland, Maier & Neustadt, P.C.

[57] ABSTRACT

A pipe is bent by advancing the pipe through a guide and into a ring disposed just upstream of said guide in the direction of pipe movement. The ring with the leading end of the pipe therein is moved by a controller along a predetermined curve along which the pipe is to be bent.

17 Claims, 5 Drawing Sheets

FIG. 5
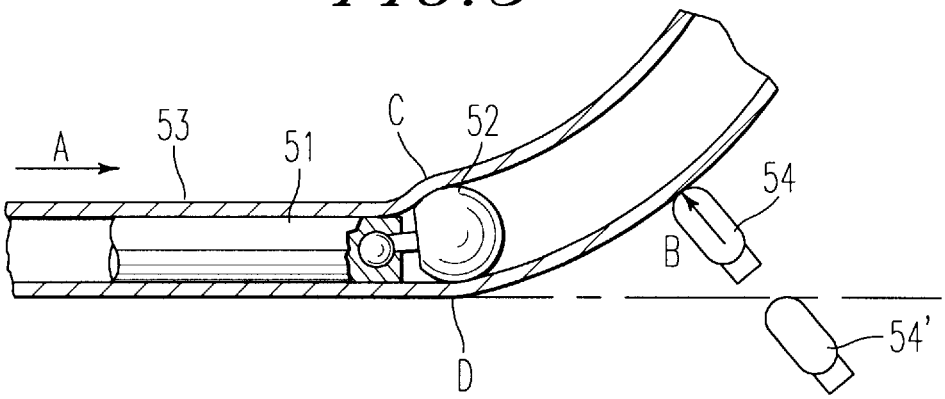
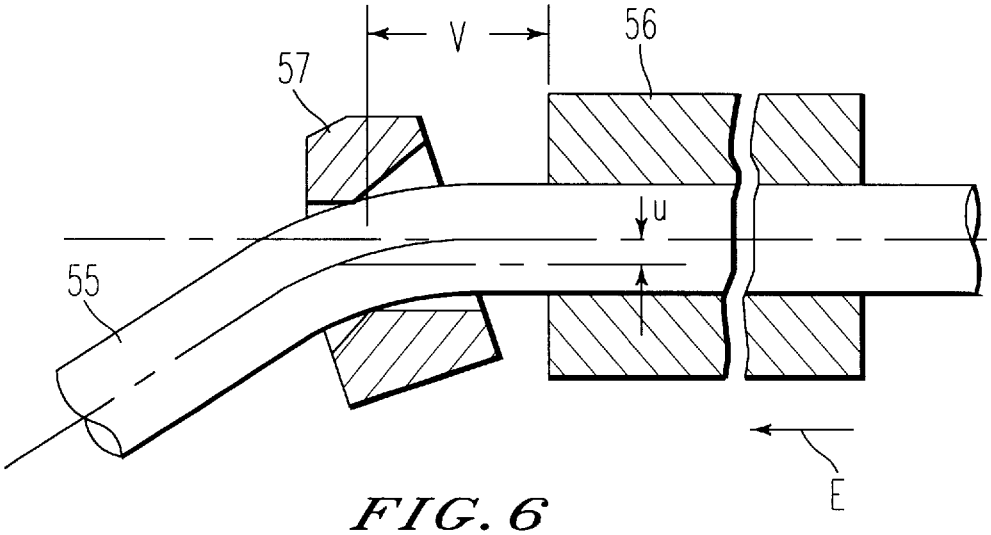
FIG. 6

METHOD AND APPARATUS FOR FORMING A BENT PIPE

BACKGROUND OF THE INVENTION

1. Field of the Invention

The present invention relates to a method for forming a bent pipe and an apparatus for the same, particularly to a method and an apparatus for bending an end portion of the pipe.

2. Discussion of the Related Art

A known technique for bending a pipe is disclosed in Japanese patent publication No. 6-42967, a main part of which is shown in FIG. 5. As shown in FIG. 5, an expansion plug 52 is pivotally connected to a tip of a mandrel 51 which is inserted in a pipe 53 and guides the pipe 53 from inside. A diameter of the expansion plug 52 is larger than an inner diameter of the pipe 53. The pipe 53 being advanced along the direction shown by arrow A in FIG. 5 is expanded as it arrives at the expansion plug 52. A bending force (shown at an arrow B in FIG. 5) is applied to the expanded pipe 53 by a bending member 54. Accordingly, the pipe 53 is bent and expanded concurrently.

According to this method of bending the pipe, the expansion plug 52 is biased toward the bending direction by the bending force applied by the bending member 54. So a circumferential inclination stress is generated in the pipe 53. The inclination stress generated at an inner side wall C of the pipe 53 is large, and the inclination stress generated at an outer side wall D of the pipe 53 is small. This stress generates another bending force. Thus, two bending forces are added to the pipe 53: the bending force by the bending member 54 and the bending force due to the inclination stress. So it is possible to bend the pipe with a small force.

Further, due to the bending force generated by the inclination stress, the thickness of an inner side wall C of the pipe 53 becomes smaller. On the other hand, by the bending force generated by the bending member 54, the thickness of the outer side wall D of the pipe 53 becomes even thinner. Therefore, by bending the pipe using two bending forces, the thickness of the whole wall of the pipe can be uniform along the circumferential direction.

In the operation of the prior art described above, before forming the bent pipe the bending member 54 is located below the mandrel 51 (as shown at 54' in FIG. 5). If the bending member is located at the position shown at 54 (not 54') before starting to bend the pipe, the pipe may buckle. Upon starting, the pipe 53 advances in the direction shown by the arrow A in FIG. 5 and is expanded by the expansion plug 52.

When an end portion of the expanded pipe 53 reaches the bending member 54', the bending member 54' moves to the location shown at 54 in FIG. 5. By further advancing the pipe 53 with the bending member located at position 54, the pipe is bent with a predetermined radius.

An end portion of the pipe passed through the expansion plug 52 before the bending member arrives at position 54 is not bent with a predetermined radius, but with a radius larger than the predetermined radius. This is because this portion of the pipe does not receive sufficient bending force by inclination stress generated when the pipe passes through the expansion plug 52.

Another prior art is shown in Japanese patent publication No. 5-12047, a main part of which is shown in FIG. 6. As shown in FIG. 6, a pipe 55 is inserted in a guide cylinder 56 which guides the pipe 55. A bending die 57 is placed downstream of the guide cylinder 56. The guide cylinder 56 externally guides the pipe 55. The bending die 57 deviates from the central axis line of the guide cylinder 56 to produce an offset u. Accordingly, when the pipe is advanced in the guide cylinder 56 and the bending die 57, a bending moment is generated on the pipe 55 between the guide cylinder 56 and the bending die 57. The distance V between the guide cylinder 56 and the bending die 57, and the offset u between the bending die 57 and the central axis line of the guide cylinder 56, are both changeable so that bent pipes having various radii can be produced.

In the prior art described above, before starting to bend the pipe, the bending die 57 is located an the central line of the guide cylinder 56 (offset u=0). Upon advancing the pipe 55 in the direction E in FIG. 5, the pipe 55 enters the bending die 57 which moves to deviate from the central axis line of the guide cylinder 56 (offset u>0). By further advancing the pipe 55 in this condition, the pipe is bent with a predetermined radius.

An end portion of the pipe 55 passed through the bending die 57 before the bending die 57 arrives at the offset u is not formed with the predetermined radius, but with a radius larger than the predetermined radius. This is because sufficient bending force by the bending moment caused by the offset u is not added to this end portion of the pipe 55.

In the two methods of forming the bent pipe explained above, it is not possible to deform the end portion of the pipe to a predetermined radius. Thus, in order to produce a bent pipe having a predetermined radius, it is necessary to cut off the end portion of the pipe.

SUMMARY OF THE INVENTION

It is a primary object of the invention to provide a method and an apparatus of forming the bent pipe in which the end portion of the pipe can be bent with a predetermined radius.

It is a further object of the invention to provide a method and apparatus of forming the bent pipe in which producing costs and a running costs are reduced.

According to the present invention, the above and other objects are achieved by a method for forming a bent pipe comprising the steps of advancing a pipe through a guide and toward a ring disposed just upstream of said guide in the direction of pipe movement; further advancing a leading end of the pipe into said ring; and moving said ring with the leading end of the pipe therein along a predetermined curve along which the pipe is to be bent.

According to another feature of the invention, an apparatus for forming the bent pipe comprises feeding means for advancing the pipe; a pipe guide disposed in an advancing direction of the pipe; a ring disposed just upstream of said guide means in said advancing direction;

ring moving means for moving said ring; and control means for controlling said ring moving means in such a manner that said ring moves along a predetermined curve along which the pipe is to be bent.

In accordance with the present invention, the ring is disposed just in front of the guide before advancing the pipe. Then the pipe is advanced and when an end portion of the pipe enters the ring, the ring member is moved along a predetermined curve along which the pipe is to be bent. Thus, the end of the pipe is bent to a predetermined curve. Further, a step of cutting off the end of the pipe is not necessary. So the producing cost and running cost are reduced.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 5 is a schematic illustration which shows a method for forming a bent pipe according to prior art; and FIG. 6 is a schematic illustration which shows another method for forming a bent pipe according to the prior art.

DESCRIPTION OF THE PREFERRED EMBODIMENTS

Figure 1:
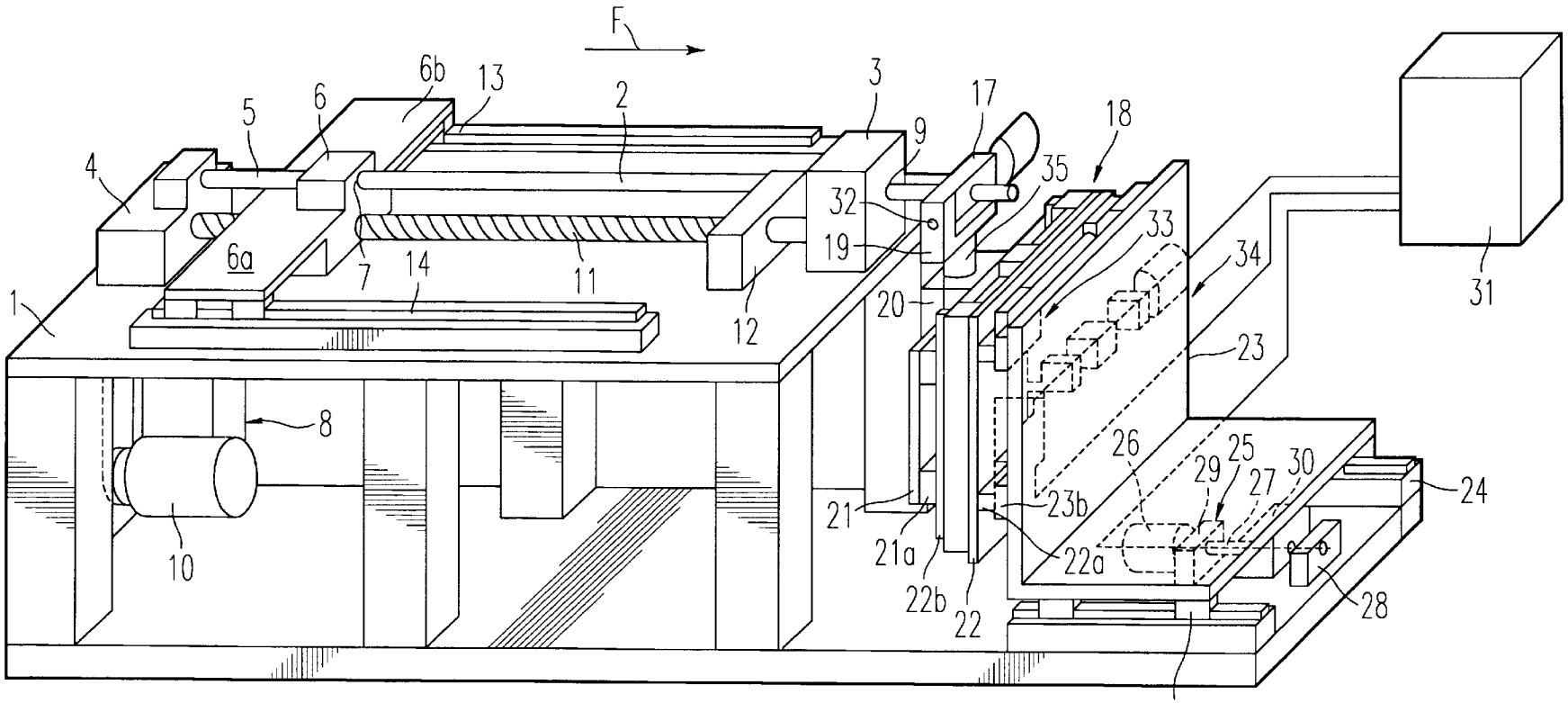
FIG. 1 is a perspective view of a bending apparatus according to an embodiment of the present invention.

Referring now to the drawings, wherein like reference numerals designate identical or corresponding parts throughout the several views, and more particularly to FIG. 1 thereof, an outside guide member 3 disposed and fixed on a machine base 1 has a bore 3*a* with an inlet 3*b* and outlet 3*c*. A pipe 2 is movably supported and guided in the bore 3*a*. An inside guide member 5 is disposed in the pipe 2. The inside guide member 5 is detachably mounted to a fixed member 4 located at the rear of the machine base 1. The inside guide member 5 extends forward in a direction shown by arrow F, and a tip end 5*a* of the inside guide member 5 is positioned in the bore 3*a*. Accordingly, the pipe 2 is held in an opening 9 formed between the wall of the bore 3*a* and the tip end 5*a*.

A feeder 6 is disposed at an end portion of the pipe 2 and has a bore 7 whose diameter is larger than an outside diameter of the inside guide member 5 but smaller than an inside diameter of the pipe 2. So the inside guide member 5 can be inserted into the bore 7 but the pipe 2 cannot. The feeder 6 is driven in direction F by a feeder moving means 8.

In order to insert the inside guide member 5 into the bore 7, the inside guide member 5 is first detached from the fixed member 4. Then the inside guide member 5 is inserted into the bore 7 from the rear and reconnected with the fixed member 4.

For driving the feeder 6 by the feeder moving unit 8, the motor 10 disposed under the fixed member 4 is connected with the screw shaft 11 via a belt (not shown). The screw shaft 11 is disposed under the inside guide member 5 and extends into the fixed member 4 via the feeder 6. A tip end portion of the screw shaft 11 is connected to the supporting member 12. An outer surface of the screw shaft 11 is formed with a male screw thread which mates with a female screw thread at an inner surface of the bore of the feeder 6.

The feeder 6 has a first wing portion 6*a* and a second wing portion 6*b*. Under the first wing portion 6*a* is disposed a rail 14 which extends along the direction F (advance direction). The rail 13 is disposed under the second wing portion 6*b* and also extends along the advance direction. When the motor 10 operates, it drives the screw shaft 11 via the belt. This drives the feeder 6 along the rail 13 and rail 14 via the mating screw threads.

Figure 2:
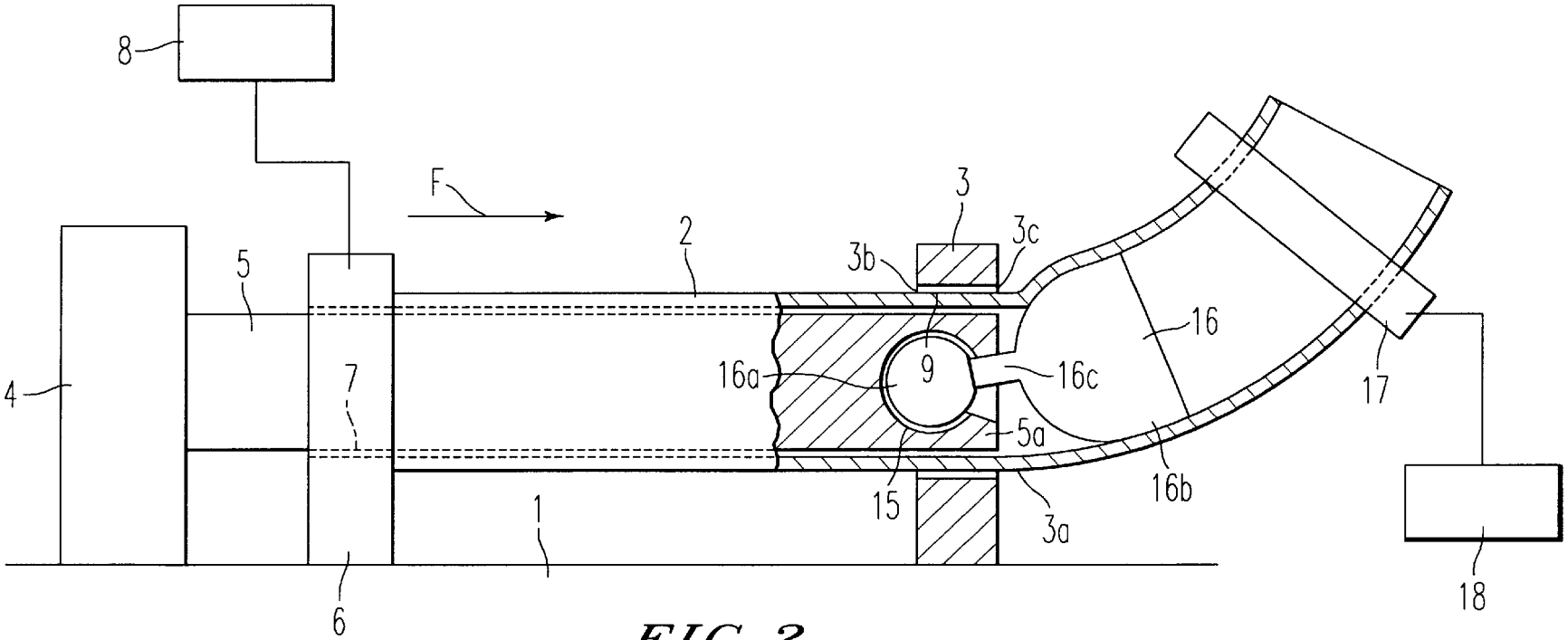
FIG. 2 is a partly sectional schematic illustration of a bending apparatus according to an embodiment of the present invention.

As shown in FIG. 2, an expansion plug 16 is disposed at the front of the inside guide member 5. The expansion plug 16 comprises a ball portion 16*a*, an expanding portion 16*b*, and a connection portion 16*c*. The ball portion 16*a* is inserted into a bore 15 formed at a tip end of the inside guide member 5 so that the expansion plug 16 is connected with the inside guide member 5 by means of ball and socket joint. Thus, the expansion plug is swingable (pivotable) around the ball portion 16*a*. A ring member 17 is disposed in front of the expansion plug 16. The ring member 17 is movable in any direction by a ring-moving means 18.

As shown in FIG. 1, the ring member 17 is connected to a ring holder 19 by pins 32 at both sides of the ring member 17. So the ring member 17 is swingable around a horizontal axis by the pins 32. The ring holder 19 is fixed to a first connecting member 35 which is swingably connected about a vertical axis to a second connecting member 20. Therefore, the ring member 17 can pivot around the vertical and horizontal axes.

The second connecting member 20 is further connected with a vertical direction moving plate 21 which has first guide rails 21*a* at both sides. The first guide rails 21*a* are engaged to other first rails 22*b* disposed on opposite ends of a horizontal direction moving plate 22 and which extend along the vertical direction. The horizontal direction moving plate 22 also has second rails 22*a* disposed on an opposite surface to a surface having the first rails 22*b*. The second rails 22*a* are at upper and lower ends of the horizontal moving plate 22 and the second rails 22*a* engage other second rails 23*b* disposed on upper and lower ends of an advance direction moving plate 23 and extended along the horizontal direction.

The advance direction moving plate 23 is "L" shaped. The second rails 23*b* are disposed on a vertical portion and third rails 23*a* are disposed on a horizontal portion of the advance direction moving plate 23. The third rails 23*a* are disposed at opposite ends of the horizontal portion of the advance direction moving plate 23 and the third rails 23*a* engage other third guide rails 24 disposed on the machine plate 1 and extended along the advance direction.

The vertical direction moving plate 21 is driven in the vertical direction by a vertical movement operation unit 33 disposed between the vertical direction moving plate 21 and the horizontal direction moving plate 22. The horizontal direction moving plate 22 is driven along the horizontal direction by a horizontal movement operation unit 34 disposed between the horizontal direction moving plate 22 and the advance direction moving plate 23. The advance direction moving plate 23 is driven along the advancing direction by an advance movement operation unit 25 disposed between the advance direction moving plate 23 and the machine base 1.

The advance movement operating unit 25 comprises a servo motor 26 fixed on the machine base 1. A screw shaft 27 is connected with an output rod of the servo motor 26. The screw shaft 27 extends along the advanced direction and is held by supporting members 28 and 29 fixed on the machine base 1. The screw shaft 27 is engaged to a female screw formed in a moving member 30 fixed on the advance direction moving plate 23.

In operation of the advance movement operation unit 25, the servo motor 26 is first started. Then rotation of the servo motor 26 transmitted to the screw shaft 27 is transferred to the moving member 30 via the mating threads. Accordingly, the moving member 30 moves in the advance direction with the advance direction moving plate 23 fixed therewith. The vertical movement operation unit 33 and the horizontal movement operation unit 34 operate in the same way.

The ring-moving means 18 consisting of the vertical movement operation unit 33, the horizontal movement operation unit 34 and the advanced movement operation unit 25 is electrically connected with a control unit 31. The control unit 31 operates the movement operation units so that the ring member 17 can freely move at all directions. Further, the feeder moving unit 8 is also connected to the control unit 31 to confirm the starting point of movement of the ring member 17.

The movement of the ring member 17 at the time when the pipe is being bent is explained as follows. First, the motor 10 is started. The rotating force generated by the motor 10 is transmitted to the screw shaft 11 via the belt and advances the feeder 6. The pipe 2 is advanced by the feeder 6 into the bore 3*a* of the outside guide member 3. The pipe 2 is further advanced around the expansion plug 16 and expanded.

Figure 3:
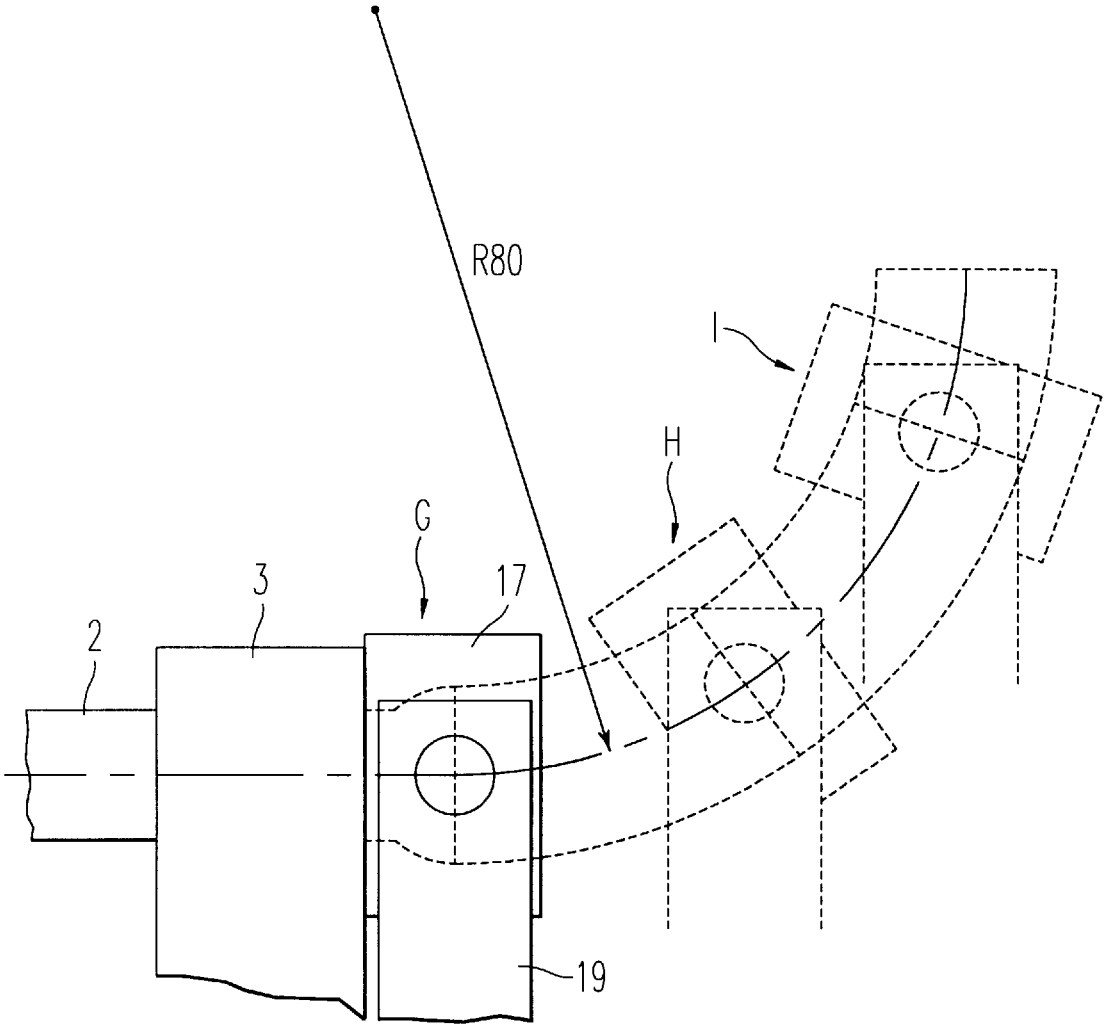
FIG. 3 is a schematic illustration which shows movement of a ring member according to an embodiment of the present invention.
Figure 4A:
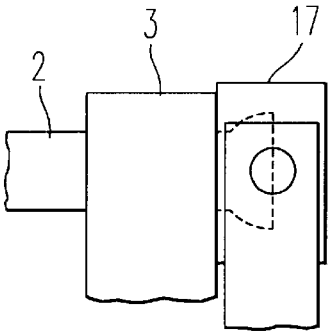
FIG. 4 is a schematic illustration which shows movement of the ring member according to another embodiment of the present invention.
Figure 4B:
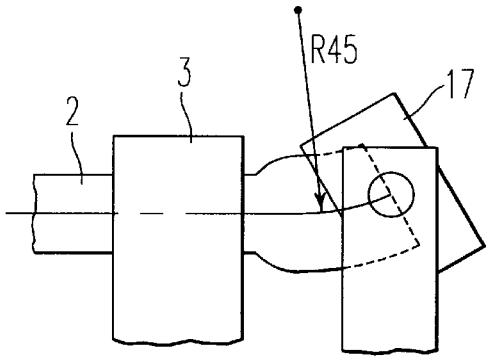
Figure 4C:
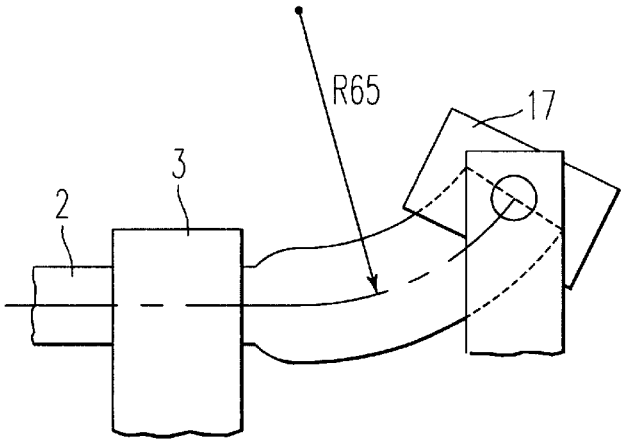
Figure 4D:
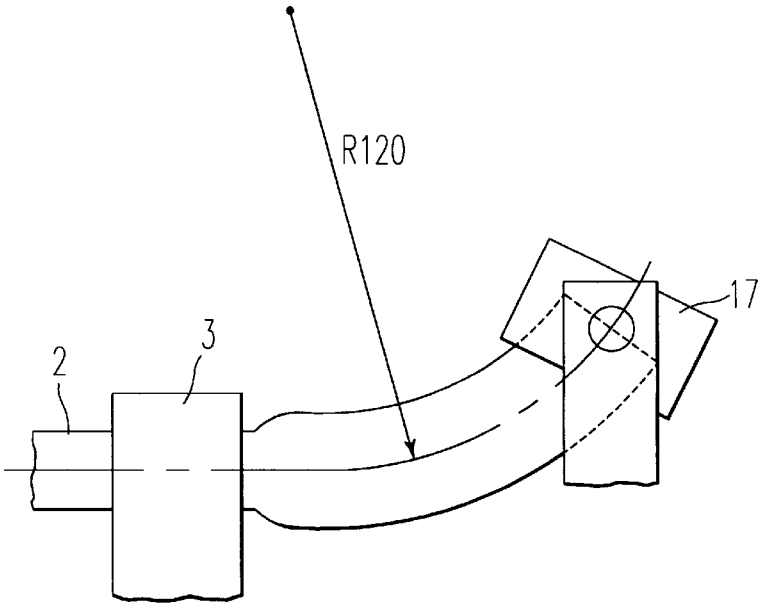

As schematically shown in FIG. 3, the ring member 17 is initially at position G just in front of the outside guide member 3 until the end portion of the pipe 2 is expanded by the expansion plug 16. When the end portion of the pipe 2 is expanded and inserted into the ring member 17, the ring member 17 moves to the position H, and then to position I, shown in FIG. 3 with the end portion of the pipe 2 inserted therein. When the ring member 17 arrives at position I, it stops moving.

The movement of the ring member 17 is controlled by the control unit 31 so that the ring member 17 moves along the predetermined curve which the pipe 2 is to be bent to form. This operation is achieved by the control unit 31 controlling the vertical movement operation unit 33, the horizontal movement operation unit 34 and the advance movement operation unit 25. In this embodiment, a locus of the center of the ring member 17 moved from position G to position I through position H is an arc with a constant diameter (e.g., radius=80 cm). So the end portion of the pipe 2 is bent with constant diameter (e.g., 80 cm). The pipe 2 is continuously fed through the ring member 17 by the feeder 6 after the ring member 17 is stopped. Therefore, the entire pipe 2 is bent to form an arc with a constant diameter (e.g., 80 cm).

According to the foregoing operation, the end portion of the pipe can be bent to form to the predetermined curve. So it is not necessary to subsequently cut off the end portion of the pipe.

Next, another preferred embodiment is explained with reference to FIGS. 4(*a*), 4(*b*), 4(*c*) and 4(*d*) which schematically show a process of movement of the ring member 17. Before the pipe bending apparatus starts, the ring member 17 is located just in front of the outside guide member 3 as shown in FIG. 4(*a*). When the apparatus starts to run and the end portion of the pipe is fed to the ring member 17, the ring member 17 sequentially moves from FIG. 4(*a*) to FIG. 4(*b*), FIG. 4(*c*) and FIG. 4(*d*). When the ring member 17 comes to the point shown in FIG. 4(*d*), it is stopped.

At the point shown in FIG. 4(*b*), the pipe 2 is bent to form an arc having a 45 cm radius if the ring member 17 is stopped there. At the point shown in FIG. 4(*c*), the pipe 2 is bent to form an arc having a 65 cm radius if the ring member 17 is stopped there. At the point shown in FIG. 4(*d*), the pipe 2 is bent to form an arc having a 120 cm radius. From the point shown in FIG. 4(*a*) to the point shown in FIG. 4(*d*), the movement of the ring member 17 is operated in such a manner that a radius of the bent pipe formed if the ring member 17 is stopped thereat becomes gradually larger. By operating the movement of the ring member 17 in such a manner that a radius of the bent pipe formed if the ring member 17 is stopped thereat is changed gradually, the end portion of the pipe can be bent with a gradually changed radius.

Further in the above described preferred embodiments, the pipe is expanded by the expansion plug before being bent. Therefore, the bent pipe having a uniform thickness along a circumferential direction can be produced.

Obviously, numerous modifications and variations of the present invention are possible in light of the above teachings. It is therefore to be understood that within the scope of the appended claims, the invention may be practiced otherwise than as specifically described herein.

What is claimed as new and is desired to be secured by Letters Patent of the United States is:

1. An apparatus for forming a bent pipe, comprising:

feeding means for advancing the pipe;

a pipe guide disposed in an advancing direction of the pipe;

a ring disposed just upstream of said guide means in said advancing direction;

ring moving means for moving said ring; and control means for controlling said ring moving means in such a manner that said ring moves along a predetermined curve along which the pipe is to be bent, wherein said ring moving means includes first ring moving means for moving said ring in the vertical direction, second ring moving means for moving said ring in the horizontal direction, and third ring moving means for moving said ring in the direction of movement of the pipe, and wherein said control means comprises means for controlling said first ring moving means, said second ring moving means and said third ring moving means to move said ring along said predetermined curve.

2. An apparatus for forming a bent pipe as set forth in claim 1, wherein said guide includes an outside guide member having a bore into which the pipe is inserted to support movement of the pipe.

3. An apparatus for forming a bent pipe as set forth in claim 1, wherein said guide includes an inside guide member disposed in the pipe and supporting movement of the pipe from inside.

4. An apparatus for forming a bent pipe as set forth in claim 1, further comprising an expansion plug having a diameter larger than an inner diameter of the pipe, said expansion plug pivotally connected to an upstream tip of said inside guide member.

5. An apparatus for forming a bent pipe as set forth in claim 4, wherein said expansion plug is connected with said inside guide member by a ball-and-socket joint.

6. A method for forming a bent pipe comprising the steps of:

advancing a pipe through a guide and toward a ring disposed just upstream of said guide in the direction of pipe movement;

further advancing a leading end of the pipe into said ring; and moving said ring with the leading end of the pipe therein along a predetermined curve along which the pipe is to be bent while controlling the position of the pipe in the vertical direction, the horizontal direction, and the direction of advancement of the pipe.

7. A method for forming a bent pipe as set forth in claim 6 further comprises the step of:

stopping said ring when said ring is at a prescribed place.

8. The method of claim 6, wherein said step of moving said ring while controlling the position of the pipe in three dimensions comprises moving said ring in the vertical direction, moving said ring in the horizontal direction, and moving said ring in the direction of movement of the pipe.

9. A method for forming a bent pipe as set forth in claim 7 further comprising the step of:

expanding the pipe before the pipe is inserted into said ring.

10. A method for forming a bent pipe as set forth in claim 9, wherein said predetermined curve is an arc having a constant radius.

11. A method for forming a bent pipe as set forth in claim 9, wherein a curvature of said predetermined curve is gradually changed as the ring is moved.

12. An apparatus for forming a bent pipe comprising:

feeding means for advancing the pipe;

a pipe guide disposed in an advancing direction of the pipe;

a ring disposed just upstream of said guide means in said advancing direction;

ring moving means for moving said ring;

control means for controlling said ring moving means in such a manner that said ring moves along a predetermined curve along which the pipe is to be bent;

an expansion plug having a diameter larger than an inner diameter of the pipe, said expansion plug pivotally connected to an upstream tip of said inside guide member; and a first ring pivot for pivoting said ring about a horizontal axis.

13. An apparatus for forming a bent pipe as set forth in claim 12, further comprising a second ring pivot for pivoting said ring about a vertical axis.

14. An apparatus for forming a bent pipe as set forth in claim 13, wherein said second ring pivot is connected with said first ring pivot.

15. An apparatus for forming a bent pipe as set forth in claim 14, wherein said first ring pivot is connected with said second ring pivot.

16. An apparatus for forming a bent pipe as set forth in claim 15, wherein said ring moving means comprise supports supporting said first and second ring pivots for movement in the vertical direction, in a horizontal advancing direction and in a horizontal direction perpendicular to the advancing direction.

17. An apparatus for forming a bent pipe as set forth in claim 16, wherein said ring moving means further comprise means controlled by said control means for moving said ring pivot supports.

* * * * *